US008905395B2

(12) United States Patent
Suzuki et al.

(10) Patent No.: US 8,905,395 B2
(45) Date of Patent: Dec. 9, 2014

(54) SHEET PROCESSING APPARATUS, IMAGE FORMING SYSTEM, AND SHEET PROCESSING METHOD

(71) Applicants: Nobuyoshi Suzuki, Tokyo (JP); Shingo Matsushita, Tokyo (JP); Takashi Saito, Kanagawa (JP); Satoshi Saito, Kanagawa (JP); Makoto Hidaka, Tokyo (JP); Katsuhiro Kosuge, Kanagawa (JP); Akihiro Musha, Kanagawa (JP); Shohichi Satoh, Kanagawa (JP); Ikuhisa Okamoto, Kanagawa (JP)

(72) Inventors: Nobuyoshi Suzuki, Tokyo (JP); Shingo Matsushita, Tokyo (JP); Takashi Saito, Kanagawa (JP); Satoshi Saito, Kanagawa (JP); Makoto Hidaka, Tokyo (JP); Katsuhiro Kosuge, Kanagawa (JP); Akihiro Musha, Kanagawa (JP); Shohichi Satoh, Kanagawa (JP); Ikuhisa Okamoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 30 days.

(21) Appl. No.: 13/719,337

(22) Filed: Dec. 19, 2012

(65) Prior Publication Data

US 2013/0154178 A1 Jun. 20, 2013

(30) Foreign Application Priority Data

Dec. 20, 2011 (JP) ..... 2011-278807

(51) Int. Cl.

| | |
|---|---|
| ***B65H 37/04*** | (2006.01) |
| ***B42C 1/12*** | (2006.01) |
| ***B65H 31/34*** | (2006.01) |
| ***B65H 39/10*** | (2006.01) |
| ***B65H 39/00*** | (2006.01) |

(52) U.S. Cl.

CPC ..... *B65H 39/00* (2013.01); *B42C 1/12* (2013.01); *B65H 2404/632* (2013.01); *B65H 31/34* (2013.01); *B65H 2301/4213* (2013.01); *B65H 39/10* (2013.01); *B65H 2301/341* (2013.01)

USPC ..... 270/58.12; 270/58.11; 399/410

(58) Field of Classification Search

CPC ..... B65H 37/04

USPC ..... 270/58.08, 58.09, 58.11, 58.12, 58.13; 399/410

See application file for complete search history.

(56) References Cited

U.S. PATENT DOCUMENTS

| | | | | |
|---|---|---|---|---|
| 4,878,656 | A * | 11/1989 | Honjo et al. | 270/58.09 |
| 4,901,994 | A * | 2/1990 | Ishiguro et al. | 270/58.14 |
| 5,797,596 | A * | 8/1998 | Morigami et al. | 270/58.11 |
| 6,233,427 | B1 * | 5/2001 | Hirota et al. | 399/407 |

(Continued)

FOREIGN PATENT DOCUMENTS

JP 3617936 11/2004

OTHER PUBLICATIONS

U.S. Appl. No. 13/471,940, filed May 15, 2012, Kei Sasaki, et al.

(Continued)

*Primary Examiner* — Patrick Mackey

(74) *Attorney, Agent, or Firm* — Harness, Dickey & Pierce, P.L.C.

(57) ABSTRACT

A sheet processing apparatus performs predetermined processing on a sheet or a sheet bundle. The sheet processing apparatus includes: a conveying unit that conveys a sheet along a conveying path; an aligning unit that, each time a sheet is conveyed by the conveying unit, aligns the sheet; a stacking unit that reverses a conveying direction of a sheet to convey the sheet backward to a branch path branched from the conveying path, and stacks the sheet in the branch path; and a binding unit that binds a sheet bundle aligned by the aligning unit, in the conveying path.

20 Claims, 14 Drawing Sheets

(56) References Cited

U.S. PATENT DOCUMENTS

| | | | | |
|---|---|---|---|---|
| 6,371,472 | B1 * | 4/2002 | Miyake et al. | 270/58.14 |
| 6,601,840 | B2 * | 8/2003 | Boss et al. | 270/58.08 |
| 6,802,501 | B2 * | 10/2004 | Boss et al. | 270/58.07 |
| 7,165,764 | B2 * | 1/2007 | Nakamura et al. | 270/58.11 |
| 7,848,697 | B2 * | 12/2010 | Honda et al. | 399/407 |
| 7,946,563 | B2 * | 5/2011 | Fukasawa et al. | 270/37 |
| 8,602,405 | B2 * | 12/2013 | Okamoto et al. | 270/58.11 |
| 2010/0258995 | A1 * | 10/2010 | Okamoto et al. | 270/58.08 |

OTHER PUBLICATIONS

U.S. Appl. No. 13/531,846, filed Jun. 25, 2012, Akihiro Musha, et al.
U.S. Appl. No. 13/537,307, filed Jun. 29, 2012, Nobuyoshi Suzuki, et al.

* cited by examiner

SHEET PROCESSING APPARATUS, IMAGE FORMING SYSTEM, AND SHEET PROCESSING METHOD

CROSS-REFERENCE TO RELATED APPLICATIONS

The present application claims priority to and incorporates by reference the entire contents of Japanese Patent Application No. 2011-278807 filed in Japan on Dec. 20, 2011.

BACKGROUND OF THE INVENTION

1. Field of the Invention

The present invention relates to a sheet processing apparatus, an image forming system, and a sheet processing method, and more particularly to a sheet processing apparatus that binds sheet-shaped recording media (hereinafter referred to as "sheets" also in the appended claims) such as sheets of paper, sheets of transfer paper and sheets, an image forming system including the sheet processing apparatus and an image forming apparatus such as a copying machine, a printing machine, a facsimile machine, or a digital multifunction peripheral (MFP) having at least two functions of these machines, and a sheet processing method performed by the sheet processing apparatus.

2. Description of the Related Art

There is well known a sheet postprocessing apparatus, a so-called finisher, that temporarily stacks, on a stacking tray, sheets each having an image formed thereon by an image forming apparatus, such as a copier, a printer, or an MFP, and discharged from the image forming apparatus, aligns the sheets, and thereafter binds the sheets using a stapler that uses a metal staple. Such a sheet postprocessing apparatus is in widespread use because it increases convenience and efficiency by automatically binding a large number of copies of sheets each having an image formed thereon.

An example of such a technique is disclosed in Japanese Patent No. 3617936. A sheet processing apparatus according to this technique is configured as follows to avoid decrease in productivity in image formation without increasing complexity, size, and production cost of the apparatus. That is, the apparatus includes a postprocessing tray arranged inside the apparatus, a conveying path to guide a sheet to the postprocessing tray, and a sheet conveying unit to convey a sheet. The apparatus stacks sheets on the postprocessing tray, performs processing such as binding on the sheets, and thereafter discharges the sheets onto an output tray. The apparatus is configured to prevent backward traveling of the sheet at a predetermined position. The apparatus includes a branch path downstream of the predetermined position and a control unit that controls the sheet conveying unit. Under control of the control unit, the sheet conveying unit can move the sheet conveyed past the predetermined position backward and hold the sheet on the branch path. The sheet conveying unit can also convey one or more sheets held on the branch path together with a next conveyed sheet toward the postprocessing tray in a state where the next conveyed sheet is stacked on the one or more sheets.

According to this technique, when performing stapling processing, sheets are temporarily stacked on a stacking tray and aligned. After that, the sheets are stapled and then discharged onto an output tray. However, during a period when the sheets are aligned and stapled, another sheet cannot be stacked on the stacking tray. Accordingly, it has been necessary to temporarily stop output from the image forming apparatus.

In contrast to hand staplers that are generally capable of binding approximately 10 sheets, mainstream models of the sheet postprocessing apparatuses are capable of binding approximately 50 sheets. This number, 50, is the number requested by many users.

However, sheet postprocessing apparatuses (finishers) capable of binding approximately 50 sheets at a maximum are undesirably about the same size as copiers or printers. As a matter of course, such a finisher is not only relatively expensive and requires large space but also consumes much resources and a large amount of energy. In recent years, users are very sensitive to cost, space, and energy and resources consumption, and therefore cost reduction, space saving, and energy and resources saving are required.

Meanwhile, number of sheets which office users bind is small such as approximately five in the majority of cases, and binding as many as approximately 50 sheets is a rare occasion. In spite of that, a user has no other choice but to purchase a sheet postprocessing apparatus capable of binding approximately 50 sheets even when frequency of binding approximately 50 sheets is low, if the user desires to enhance efficiency in sheet processing. In other words, there have been only two choices: purchasing a sheet postprocessing apparatus capable of binding approximately 50 sheets to enhance efficiency, or giving up enhancing efficiency, in which case a user performs manual binding using a hand stapler.

There is a need to provide a sheet processing apparatus capable of low-volume binding while satisfying demands for cost reduction, space saving, resources saving, and energy saving.

SUMMARY OF THE INVENTION

It is an object of the present invention to at least partially solve the problems in the conventional technology.

A sheet processing apparatus performs predetermined processing on a sheet or a sheet bundle. The sheet processing apparatus includes: a conveying unit that conveys a sheet along a conveying path; an aligning unit that, each time a sheet is conveyed by the conveying unit, aligns the sheet; a stacking unit that reverses a conveying direction of a sheet to convey the sheet backward to a branch path branched from the conveying path, and stacks the sheet in the branch path; and a binding unit that binds a sheet bundle aligned by the aligning unit, in the conveying path.

An image forming system includes a sheet processing apparatus as described above.

A sheet processing method is to perform predetermined processing on a sheet or a sheet bundle. The sheet processing method includes: conveying, by a conveying unit, a sheet along a conveying path; aligning, each time a sheet is conveyed by the conveying unit, the sheet; stacking, during the aligning, a sheet in a branch path branched from the conveying path by reversing a conveying direction of the sheet to convey the sheet backward to the branch path; and binding an aligned sheet bundle stacked at the stacking, in the conveying path.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

According to an aspect of the present invention, aligning, stacking, and low-volume binding can be performed on an existing conveying path without an addition of a large mechanism.

An embodiment of the present invention is described below with reference to the accompanying drawings.

Figure 1:
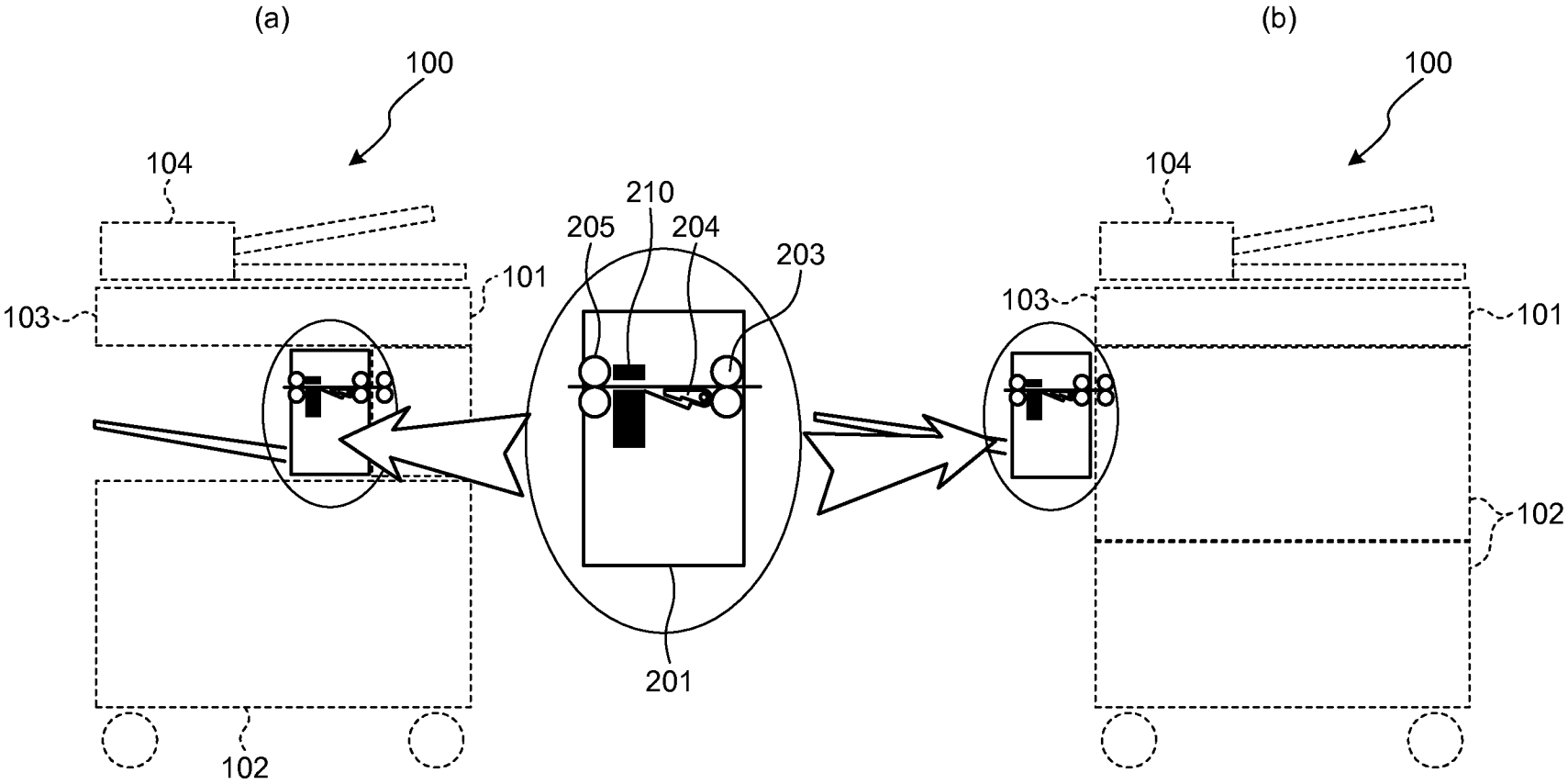
FIG. 1 is a diagram illustrating two arrangements of an image forming system according to an embodiment of the present invention.

FIG. 1 is a diagram illustrating two arrangements of an image forming system according to an embodiment of the present invention. An image forming system 100 according to the present embodiment includes an image forming apparatus 101 and a sheet postprocessing apparatus (finisher) 201 as a sheet processing apparatus. The sheet postprocessing apparatus 201 is, so to speak, a conveying-path binding apparatus arranged in a sheet conveying path extending from the image forming apparatus 101. FIG. 1(*a*) illustrates an arrangement in which the sheet postprocessing apparatus 201 is placed in a conveying path of the image forming apparatus 101. FIG. 1(*b*) illustrates an arrangement in which the sheet postprocessing apparatus 201 is placed outside a conveying path of the image forming apparatus 101. The sheet postprocessing apparatus 201 has an aligning function of stacking and aligning sheets in a conveying path and a binding function of binding the aligned sheet bundle in the conveying path. The arrangement illustrated in FIG. 1(*a*) is also referred to as an internal processing apparatus because postprocessing is performed inside a body of the image forming apparatus 101. In this way, the sheet postprocessing apparatus 201 according to the present embodiment is compact and can be attached or placed either inside or on a side surface of the image forming apparatus 101 depending on a form of the image forming apparatus 101.

The image forming apparatus 101 includes an image-forming engine unit 102 that includes an image processing unit and a sheet feed unit, a scan engine unit 103 that scans an image and converts the image into image data, and an automatic document feeder (ADF) 104 that automatically delivers a document to be scanned to the scan engine unit 103. In the arrangement illustrated in FIG. 1(*a*), a discharging part of a sheet on which an image is formed is arranged inside the image forming apparatus 101. In the arrangement illustrated in FIG. 1(*b*), a discharging part of a sheet on which an image is formed is arranged outside the image forming apparatus 101 discharges.

Figure 2:
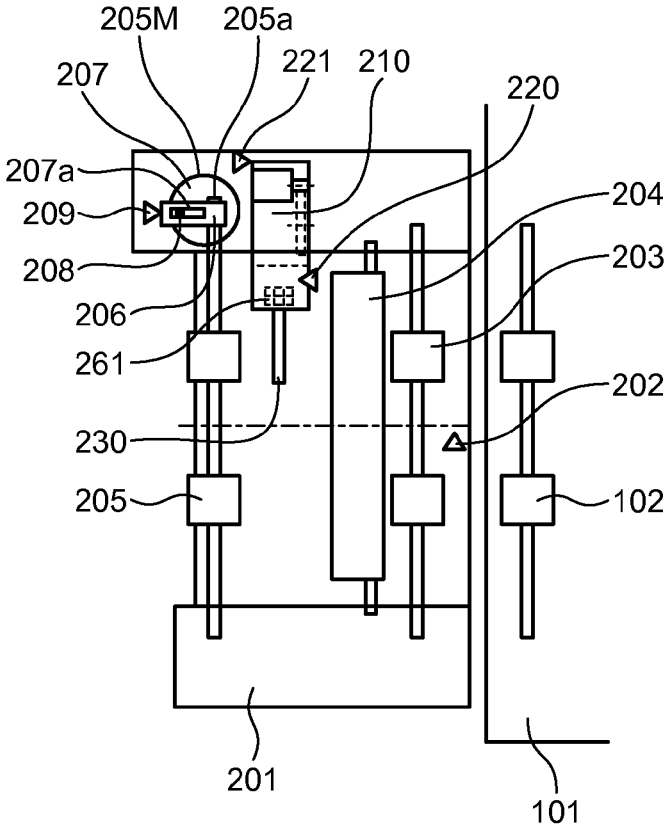
FIG. 2 is a plan view of a sheet postprocessing apparatus illustrated in FIG. 1.
Figure 3:
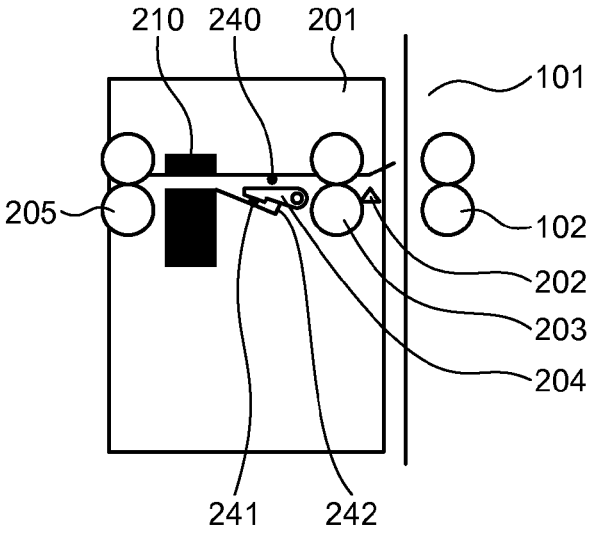
FIG. 3 is a front view of the sheet postprocessing apparatus illustrated in FIG. 1.

FIG. 2 is a plan view of the sheet postprocessing apparatus 201 illustrated in FIGS. 1(*a*) and 1(*b*). FIG. 3 is a front view of the sheet postprocessing apparatus 201. Referring to FIGS. 2 and 3, the sheet postprocessing apparatus 201 includes an entry sensor 202, an entry roller 203, a branching claw 204, a binding device 210, and a discharging roller 205 arranged along a sheet conveying path 240 in this order from an entrance side. The entry sensor 202 detects a front end (which is the leading end in a sheet conveying direction in which the sheet is delivered into the sheet postprocessing apparatus 201), a rear end (which is the trailing end in the sheet conveying direction), and presence/absence of a sheet that is discharged from discharging rollers 102 of the image forming apparatus 101 and delivered into the sheet postprocessing apparatus 201. A sensor of a reflected-light-detection type is used as the entry sensor 202, for example. A sensor of a transmitted-light-detection type can be used in lieu of the reflected-light sensor. The entry roller 203 is arranged at the entrance of the sheet postprocessing apparatus 201 and has a function of receiving a sheet discharged by the discharging rollers 102 of the image forming apparatus 101 and delivering the sheet into the sheet postprocessing apparatus 201. There are also provided a driving source (driving motor) that can control stop, rotation, and a conveyance amount, and a central processing unit (CPU) 201*a* that controls the driving source, which will be described later. The entry roller 203 also performs skew correction by causing the front end of the sheet conveyed from the image forming apparatus 101 to abut against a nip between the entry roller 203 and a roller paired therewith.

The branching claw 204 is arranged downstream of the entry roller 203. The branching claw 204 is provided to guide the rear end of the sheet to a branch path 241. After the rear end of the sheet has been past the branching claw 204, the branching claw 204 swings clockwise in FIG. 3 and the sheet is conveyed in a direction opposite to a delivering direction. As a result, the rear end of the sheet is guided to the branch path 241. The branching claw 204 is driven by a solenoid to swing as will be described later. A motor can be used in lieu of the solenoid. The branching claw 204 is driven counterclockwise in FIG. 3, thereby being able to press a sheet or a sheet bundle against a conveying surface of the branch path 241. The branching claw 204 can thus hold the sheet or the sheet bundle on the branch path 241.

The discharging roller 205 is arranged immediately upstream of a most downstream exit of the conveying path 240 of the sheet postprocessing apparatus 201 and has functions of conveying, shifting and discharging sheets. As in the entry roller 203, there is provided a driving source (driving motor) that can control stop, rotation, and a conveyance amount of the discharging roller 205 and the driving source is controlled by the CPU 201*a*. A shift mechanism 205M performs shifting of the discharging roller 205. The shift mechanism 205M includes a shift link 206, a shift cam 207, a shift cam stud 208, and a shift-home-position sensor 209.

The shift link 206 is arranged on a shaft end 205*a* of the discharging roller 205 and receives a moving force for the shifting. The shift cam 207 includes the shift cam stud 208 and is a rotating disc-like member. Rotation of this member displaces the discharging roller 205 in a direction perpendicular to the sheet conveying direction via the shift cam stud 208 that is movably inserted in a shift-link elongated hole 207*a*. This displacement is referred to as the shifting. The shift cam stud 208 has a function of converting the rotational movement of the shift cam 207 into a linear movement of the discharging roller 205 in the axial direction thereof by being interlocked with the shift-link elongated hole 207*a*. The shift-home-position sensor 209 detects the shift link 206. A position of the shift link 206 where the shift link 206 is detected by the shift-home-position sensor 209 is determined as a home position, with reference to which rotation of the shift cam 207 is controlled. This control is performed by the CPU 201*a*.

The binding device 210 includes a sheet-end detection sensor 220, a binding-device-home-position sensor 221, and a guide rail 230 to move the binding device. The binding device 210 is a mechanical device that binds a sheet bundle PB and is what is called a stapler. The binding device 210 according to the present embodiment has a function of binding sheets together by pinching and pressing the sheets between a pair of teeth-like members 261 to deform the sheets and cause fibers of the sheets to be entangled with one another. This kind of binding is referred to as compression binding. There are also known hand staplers that employ binding devices of other binding methods including a half-blanking method, a method of cutting and folding sheets, and a method of cutting and folding sheets to further causing a cut portion of the sheets to pass through a cut opening of the sheets. In any case, such a hand stapler contributes resources saving greatly because it reduces consumption of consumables, facilitate recycling, and allow the bound sheets to be put into a shredder as is. Accordingly, it is desired for sheet postprocessing apparatuses, or what are referred to as finishers, to be equipped with a stapler capable of binding sheets without using metal staples by using, for example, compression binding.

As a hand stapler that performs compression binding include, a binding device disclosed in Japanese Examined Utility Model Application Publication No. S36-13206 is known. As a hand stapler that binds sheets by cutting and folding sheets to further cause a cut portion of the sheets to pass through a cut opening of the sheets, a binding device disclosed in Japanese Examined Utility Model Application Publication No. S37-7208 is known.

The sheet-end detection sensor 220 detects a side end of a sheet. Alignment of the sheet is performed with reference to a position where the sheet-end detection sensor 220 detects a side end of a sheet. The binding device is movable in the sheet width direction. The binding-device-home-position sensor 221 detects the binding device 210 moving in the sheet width direction when the binding device 210 is at its home position that is set at a position where the binding device 210 does not interfere with a conveyed sheet even when the sheet is of maximum size. The guide rail 230 guides movement of the binding device 210 so that the binding device 210 can move in the sheet width direction stably. The guide rail 230 is placed in such a manner that the binding device 210 can move in the direction perpendicular to the sheet conveying direction along the conveying path 240 of the sheet postprocessing apparatus 201 from the home position to a position where the binding device 210 can bind sheets of minimum size. The binding device 210 is moved by a moving mechanism, including a driving motor (not shown), along the guide rail 230.

The conveying path 240 is to convey an accepted sheet and discharge the sheet. The conveying path 240 extends through the sheet postprocessing apparatus 201 from its entrance to its exit. The branch path 241 is a conveying path into which a sheet is delivered backward (by being switched back) with the rear end of the sheet first. The branch path 241 branches off from the conveying path 240. The branch path 241 is provided to stack and align sheets, and functions as a stacking unit. An abutting surface 242 is provided on a distal end of the branch path 241 and is a reference surface on which the rear end of the sheet is to be brought into abutment to be aligned therewith. The teeth-like members 261 of the present embodiment are a pair of members having projections and depressions that allow the members to mesh with each other to pinch and press a target therebetween. The teeth-like members 261 provide the compression binding function by pinching a sheet bundle therebetween and applying a pressure to the sheet bundle.

Figure 4:
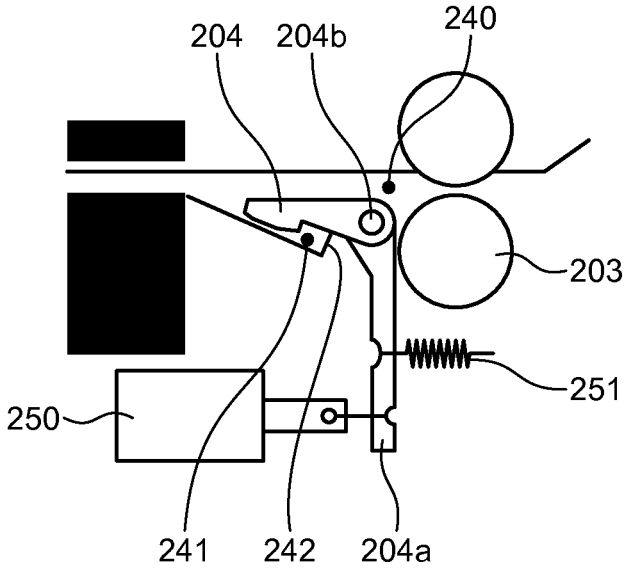
FIG. 4 is a diagram illustrating a branching claw, which is illustrated in FIG. 3, and relevant portions around the branching claw of the sheet postprocessing apparatus in a sate when a sheet is conveyed forward.
Figure 5:
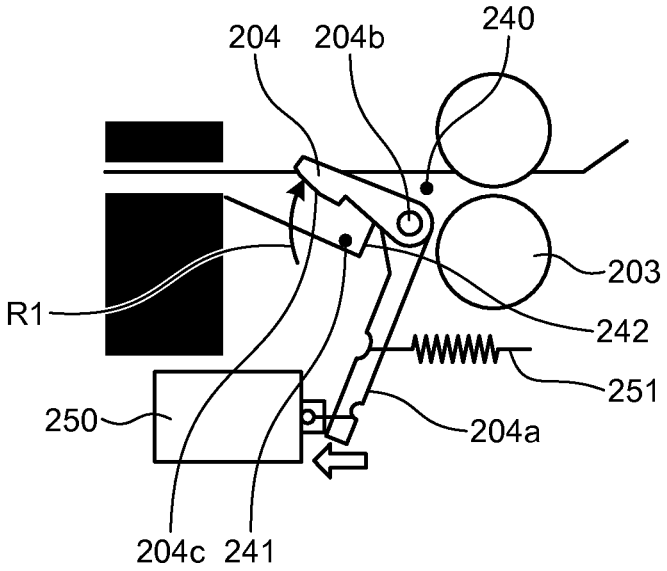
FIG. 5 is a diagram illustrating the branching claw, which is illustrated in FIG. 3, and relevant portions around the branching claw of the sheet postprocessing apparatus in a sate when a sheet is switched back.

FIGS. 4 and 5 are diagrams illustrating the branching claw 204 and relevant portions around the branching claw 204 of the sheet postprocessing apparatus 201. FIG. 4 illustrates a relevant mechanism in a state when a sheet is conveyed forward. FIG. 5 illustrates the relevant mechanism when a sheet is switched back. The branching claw 204 is configured to swing within a preset range of an angle about a fulcrum shaft 204*b* to switch a sheet conveying pathway between the conveying path 240 and the branch path 241. A home position of the branching claw 204 is the position illustrated in FIG. 4 where a sheet accepted from a right side in FIGS. 4 and 5 can be conveyed downstream smoothly. The branching claw 204 is constantly resiliently biased by a spring 251 counterclockwise in FIGS. 4 and 5.

The spring 251 is hooked onto a branching claw movable lever section 204*a*. A plunger of a branching solenoid 250 is linked to the branching claw movable lever section 204*a*. When the state illustrated in FIG. 4 is reached after a sheet is conveyed onto the branch path 241 in the state illustrated in FIG. 5, a surface of the branch path 241 and the branching claw 204 can hold the sheet on the branch path 241 by pinching the sheet therebetween. Switching of the conveying pathway is performed as follows. When the branching solenoid 250 is switched on, the branching claw 204 swings in a direction indicated by arrow R1 in FIG. 5 to close the conveying path 240 and open the branch path 241, thereby being able to guide the sheet to the branch path 241.

Figure 6:
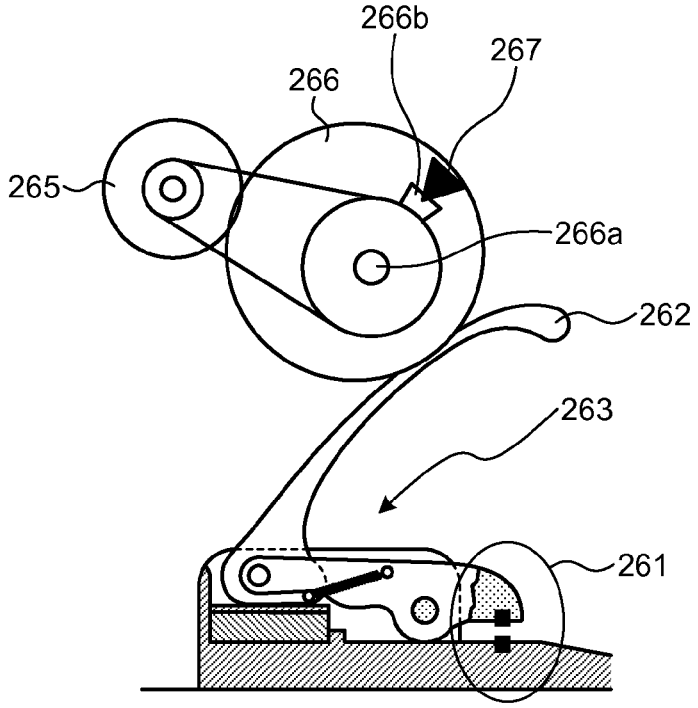
FIG. 6 is a diagram illustrating a binding device in a not-binding state.
Figure 7:
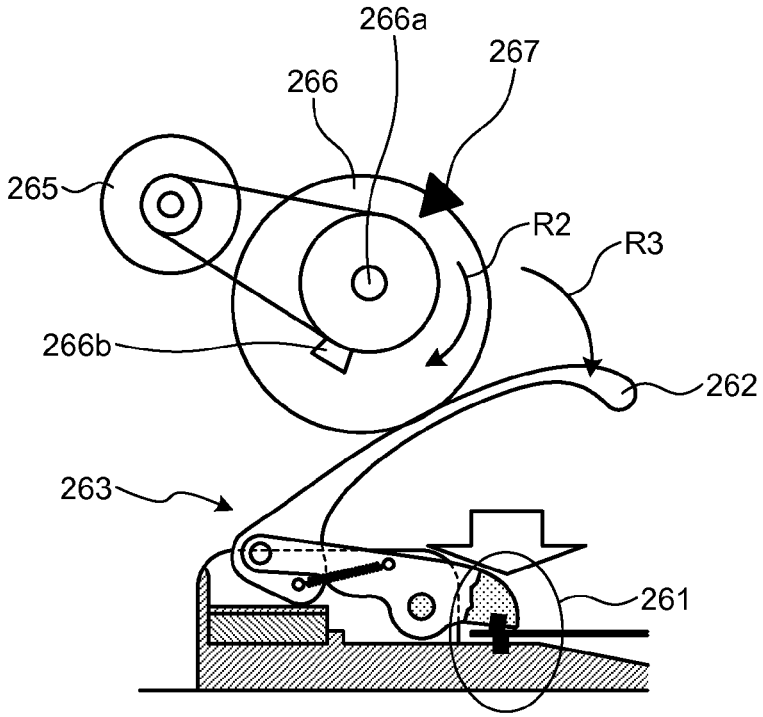
FIG. 7 is a diagram illustrating the binding device illustrated in FIG. 6 in a binding state.

FIGS. 6 and 7 are diagrams illustrating the binding device 210 according to the present embodiment in detail. The binding device 210 includes the teeth-like members 261, a pressing lever 262, a link group 263, a driving motor 265, an eccentric cam 266, and a cam-home-position sensor 267. The teeth-like members 261 are the pair of the upper pressing member and the lower pressing member having shapes configured to mesh with each other. The teeth-like members 261 are located at a driven end of the link group 263, which is a combination of plurality of links, and moved toward and away from each other by operation of applying and realizing pressure to the pressing lever 262, which is a driving end.

The pressing lever 262 is turned by rotation of the eccentric cam 266. The eccentric cam 266 receives a driving force from the driving motor 265 that rotates the eccentric cam 266. A rotational position of the cam is controlled based on detection data output from the cam-home-position sensor 267. A distance between a rotating shaft 266*a* and a cam surface of the eccentric cam 266 depends on the rotational position. A pressing amount of the pressing lever 262 depends on this distance. A home position of the eccentric cam 266 is a position where the cam-home-position sensor 267 detects a feeler 266*b* which is a detection target of the eccentric cam 266. As illustrated in FIG. 6, the teeth-like members 261 are in an open state when the rotational position of the eccentric cam 266 is at the home position. In this state, binding is disabled and the teeth-like members 261 can accept a sheet bundle.

When binding a sheet bundle, the sheet bundle is inserted between the teeth-like members 261 that are in the open state illustrated in FIG. 6, and the driving motor 265 is then rotated. When the driving motor 265 starts rotating, the eccentric cam 266 rotates in a direction indicated by arrow R2 in FIG. 7. As the eccentric cam 266 rotates in this manner, the cam surface of the eccentric cam 266 is displaced, causing the pressing lever 262 to turn in a direction indicated by arrow R3 in FIG. 7. This torque of the pressing lever 262 is multiplied via the link group that utilizes the principle of levers, and transmitted to the teeth-like members 261 at the driven end.

At a point in time where the eccentric cam 266 has rotated a preset degree, the teeth-like members 261 mesh with each other, pinch the sheet bundle therebetween and press the sheet bundle. By being pressed in this way, the sheet bundle is deformed, and fibers of adjacent sheets are entangled, causing the sheet bundle to be bound together. Thereafter, the driving motor 265 is rotated in reverse, and stopped according to detection data output from the cam-home-position sensor 267. Accordingly, the upper and lower teeth-like members 261 return to the state illustrated in FIG. 6 where the sheet bundle is movable. The lever 262 is resilient so as to be deformed when an excessive pressure is applied to the lever 262 to relieve the excessive pressure.

FIGS. 8A to 16B are operation explanatory diagrams illustrating binding operation of online binding performed by the binding device 210 of the sheet postprocessing apparatus 201. FIGS. 8A, 9A, 10A, 11A, 12A, 13A, 14A, 15A, and 16A are plan views. FIGS. 8B, 9B, 10B, 11B, 12B, 13B, 14B, 15B, and 16B are front views. Meanwhile, the online binding according to the present embodiment denotes successively accepting and aligning and biding sheets on each of which an image is just formed by the image forming apparatus 101 in the state where the sheet postprocessing apparatus 201 is attached to a discharging port of the image forming apparatus 101. In contrast, manual binding, which will be described later, denotes binding sheets that has been separately printed by the image forming apparatus 201 or other units, using the binding device 210 of the sheet postprocessing apparatus 201. Because the manual binding is not performed as a part of an operation sequence that continues from discharging of a sheet from the image forming apparatus 201, the manual binding is included in non-online binding.

Figure 8A:
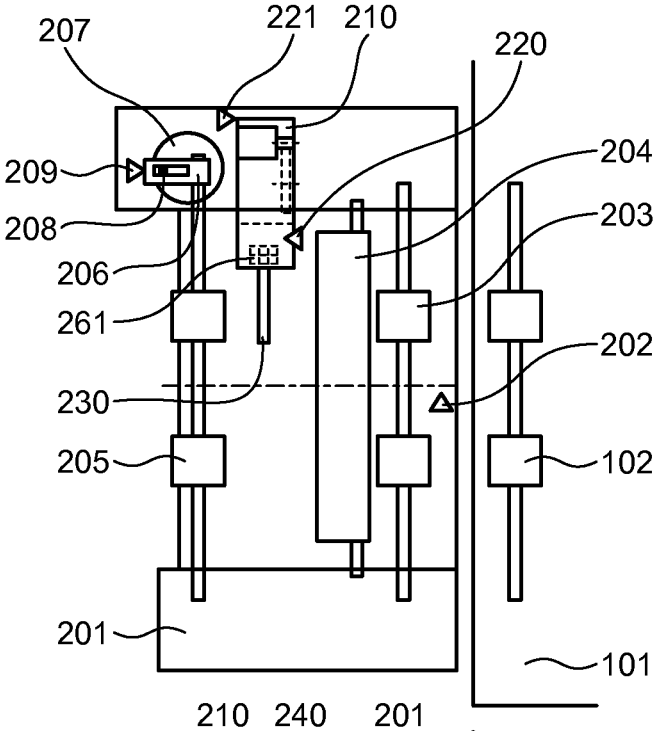
FIGS. 8A and 8B are operation explanatory diagrams illustrating a state where initialization for online binding to be performed by the sheet postprocessing apparatus is completed.
Figure 8B:
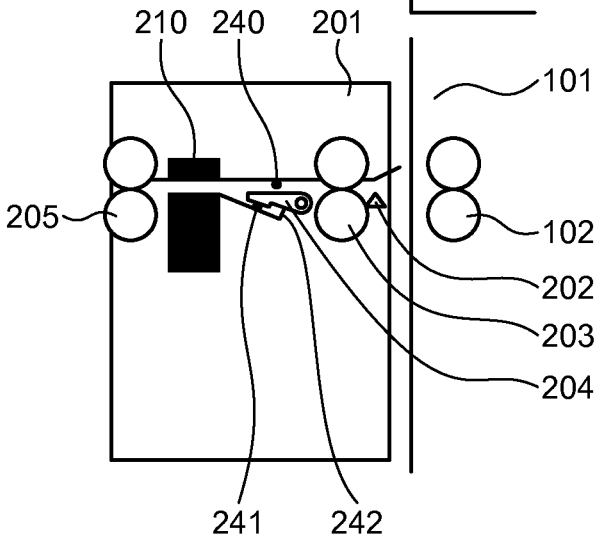

FIGS. 8A and 8B are diagrams illustrating a state where initialization for the online binding is completed. When the image forming apparatus 101 starts outputting sheets each having an image formed thereon, various parts of the sheet postprocessing apparatus 201 move to their home positions to complete the initialization. FIGS. 8A and 8B illustrate the state at this time.

Figure 9A:
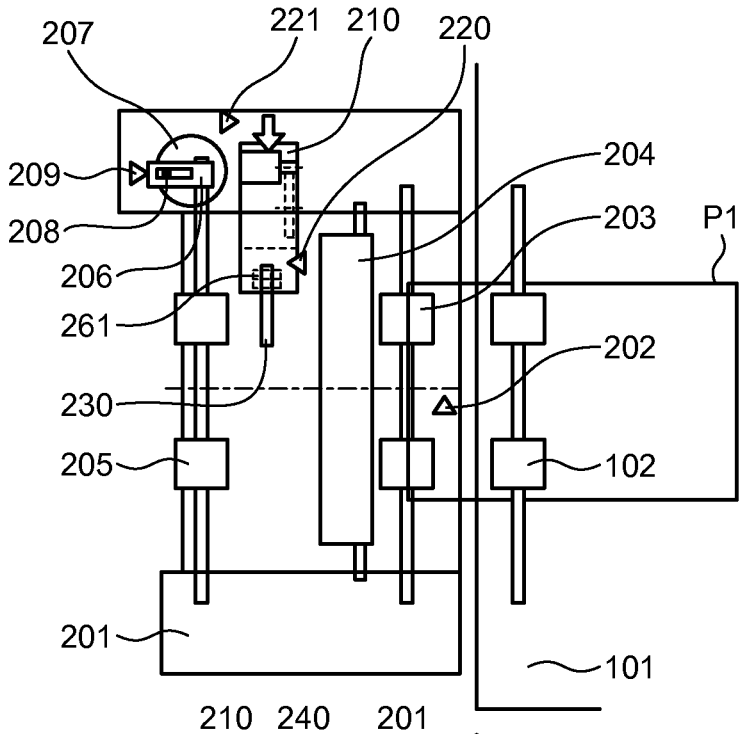
FIGS. 9A and 9B are operation explanatory diagrams illustrating a state, which follows the state illustrated in FIGS. 8A and 8B, immediately after when a first sheet is discharged from an image forming apparatus and delivered into the sheet postprocessing apparatus.
Figure 9B:
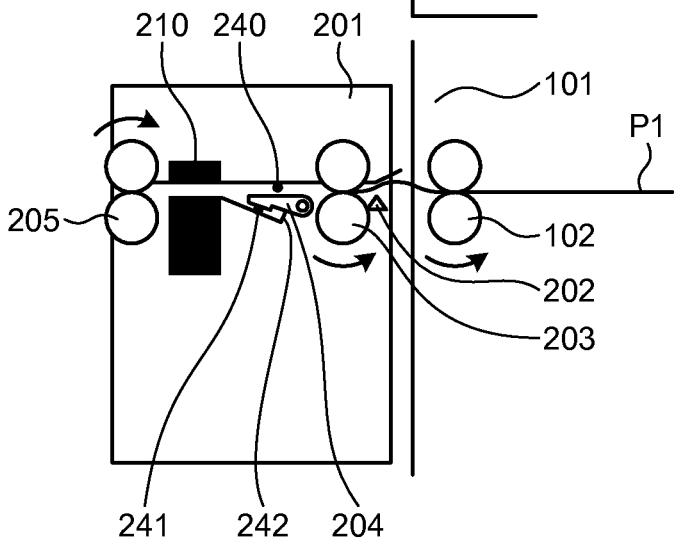

FIGS. 9A and 9B are diagrams illustrating a state immediately after when a first sheet P1 is discharged from the image forming apparatus 101 and delivered into the sheet postprocessing apparatus 201. The CPU 201*a* of the sheet postprocessing apparatus 201 receives mode data about a control mode of sheet processing and sheet data from a CPU of the image forming apparatus 101 and enters an acceptance-ready state based on the data before the sheet P1 is delivered from the image forming apparatus 101 into the sheet postprocessing apparatus 201.

Three modes, which are a straight mode, a shift mode, and a binding mode, are provided as the control mode. In the straight mode, the entry roller 203 and the discharging roller 205 start rotating in the sheet conveying direction in the acceptance-ready state. Sheets P1, P2, . . . , Pn are successively conveyed and discharged. After the last sheet Pn has been discharged, the entry roller 208 and the discharging roller 205 are stopped. Here, n is a positive integer greater than one.

In the shift mode, the entry roller 203 and the discharging roller 205 start rotating in the conveying direction in the acceptance-ready state. Shift-discharging operation is performed as follows. When the sheet P1 that is accepted is conveyed to a point where a rear end of the sheet P1 leaves the entry roller 203, the shift cam 207 is rotated by a preset amount, thereby shifting the discharging roller 205 in its axial direction. The sheet P1 is also shifted together with the shifting of the discharging roller 205 at this time. When the sheet P1 has been discharged, the shift cam 207 rotates to return to its home position to be ready to accept the next sheet P2. This shift operation of the discharging roller 205 is repeatedly performed until the last sheet Pn of the same copy has been discharged. As a result, the sheet bundle PB of one copy (one volume) is discharged and stacked with being shifted to one side. When a first sheet P1 of a next copy has been delivered into the sheet postprocessing apparatus 201, the shift cam 207 rotates in a direction opposite to the direction of the previous copy. Accordingly, the sheet P1 is shifted to a side opposite to the side to which the sheets of the previous copy is shifted, and discharged.

In the binding mode, the entry roller 203 is at rest in the acceptance-ready state, while the discharging roller 205 starts rotating in the conveying direction. The binding device 210 moves to a standby position where the binding device 210 is withdrawn from the range of the sheet width by a preset distance. In this case, the entry roller 203 functions also as a registration roller. More specifically, when the first sheet P1 is delivered into the sheet postprocessing apparatus 201 and the front end of the sheet P1 is detected by the entry sensor 202, the front end of the sheet P1 abuts on the nip of the entry roller 203. The sheet P1 is conveyed by the discharging rollers 102 of the image forming apparatus 101 by a distance that causes the sheet P1 to be bent to a certain degree. After the sheet P1 has been conveyed by the distance, the entry roller 203 starts to be rotated. As a result, skew correction of the sheet P1 is performed. FIGS. 9A and 9B illustrate the state at this time.

Figure 10A:
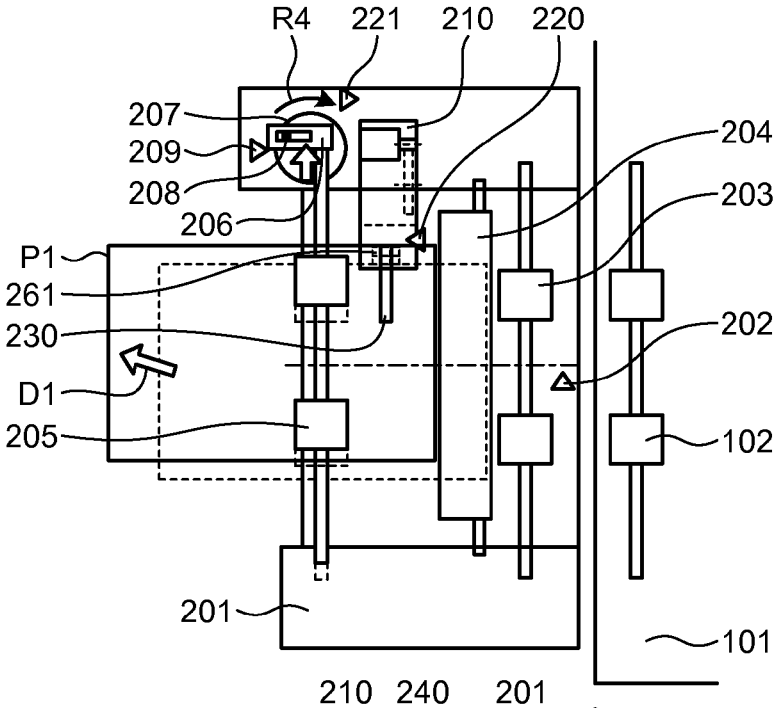
FIGS. 10A and 10B are operation explanatory diagrams illustrating a state, which follows the state illustrated in FIGS. 9A and 9B, where a rear end of the sheet has left a nip of an entry roller and passed through a branch path.
Figure 10B:
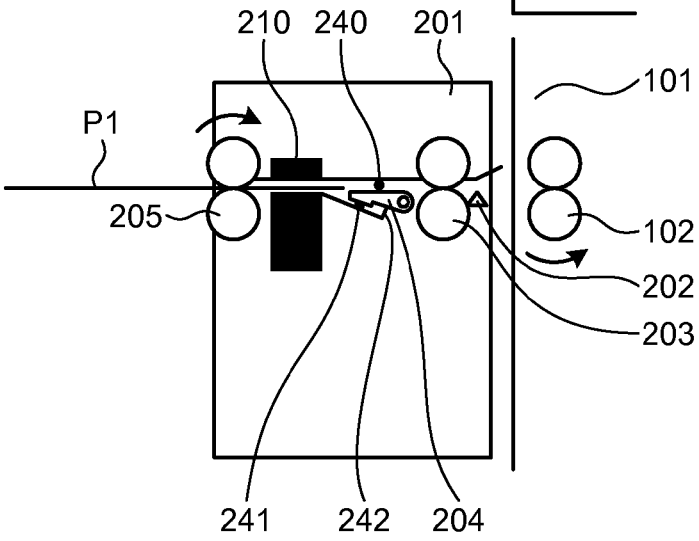

FIGS. 10A and 10B are diagrams illustrating a state where the rear end of the sheet P1 has left the nip of the entry roller 203 and passed through the branch path 241. A distance the sheet P1 is conveyed is obtained by taking a count based on detection data of the rear end of the sheet output from the entry sensor 202, causing the CPU 201*a* to recognize position data about the position of the sheet being conveyed. When the rear end of the sheet passes through the nip of the entry roller 203, the entry roller 203 stops rotating to accept the next sheet P2. Concurrent therewith, the shift cam 207 rotates in a direction indicated by arrow R4 in FIG. 10A (clockwise in FIG. 10A), causing the discharging roller 205 to start shifting in the axial direction with the sheet P1 nipped by the discharging roller 205. As a result, the sheet P1 is conveyed obliquely in a direction indicated by arrow D1 in FIG. 10A. Thereafter, when the sheet-end detection sensor 220 provided together with or built in the binding device 210 detects a side end of the sheet P1, the shift cam 207 stops rotating, and then rotates in reverse. After that, when the sheet-end detection sensor 220 does not detect the sheet P any more, the shift cam 207 stops rotating. When the operation is completed and the rear end of the sheet is at a predetermined position past an end of the branching claw 204, the discharging roller 205 stops rotating.

Figure 11A:
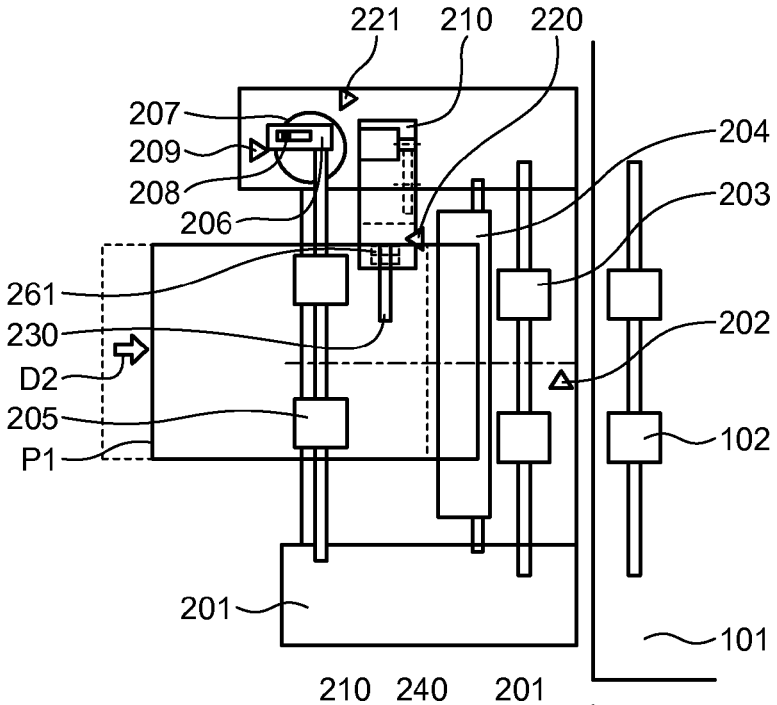
FIGS. 11A and 11B are operation explanatory diagrams illustrating a state, which follows the state illustrated in FIGS. 10A and 10B, where the sheet is switched back for alignment in a sheet conveying direction.
Figure 11B:
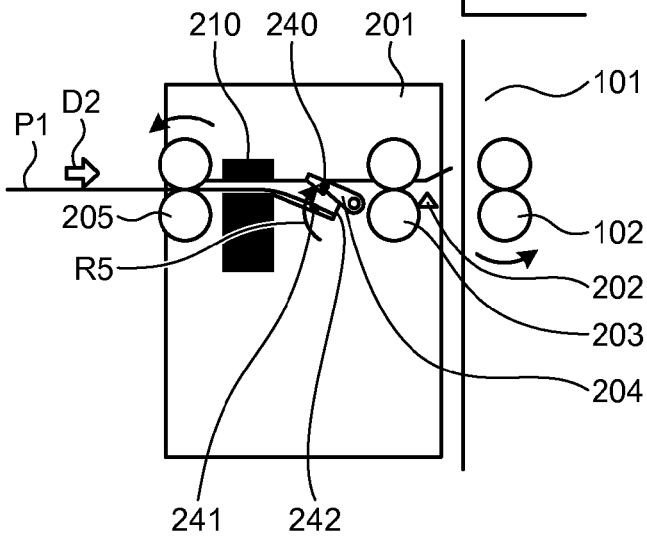

FIGS. 11A and 11B are diagrams illustrating a state where the sheet P1 is switched back for alignment of the end of the sheet P1 in the conveying direction. After the branching claw 204 is turned in a direction indicated by an arrow R5 in FIG. 11B to switch the conveying pathway to the branch path 241, the discharging roller 250 is rotated in reverse. This causes the sheet P1 to be switched back in a direction indicated by arrow D2, and the rear end of the sheet P1 is delivered into the branch path 241 and further is brought into abutment with the abutting surface 242. By this abutment of ear end of the sheet P1, the rear end of the sheet P1 is aligned with reference to the abutting surface 242. When the sheet P1 is aligned, the discharging roller 205 stops rotating. The discharging roller 205 is configured to slip so as not to apply a conveying force to the sheet P1 when the sheet P1 abuts on the abutting surface 242. In other words, the discharging roller 205 is configured to prevent the sheet P1 from being further conveyed and buckling after the sheet P1 switched backward has abutted on the abutting surface 242 and been aligned with reference to the abutting surface 242.

Figure 12A:
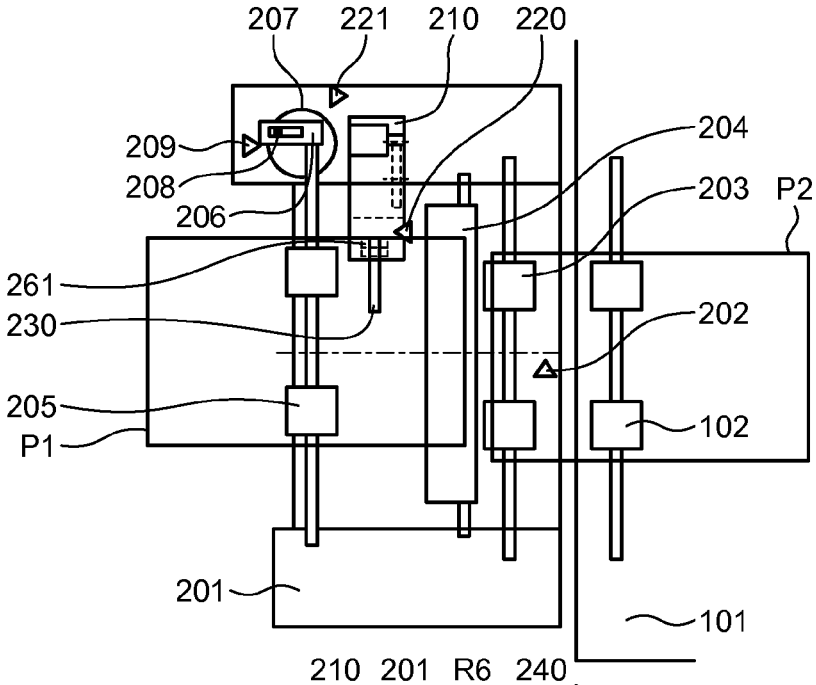
FIGS. 12A and 12B are operation explanatory diagrams illustrating a state, which follows the state illustrated in FIGS. 11A and 11B, where the first sheet is held on the branch path and a next second sheet is delivered into the sheet postprocessing apparatus.
Figure 12B:
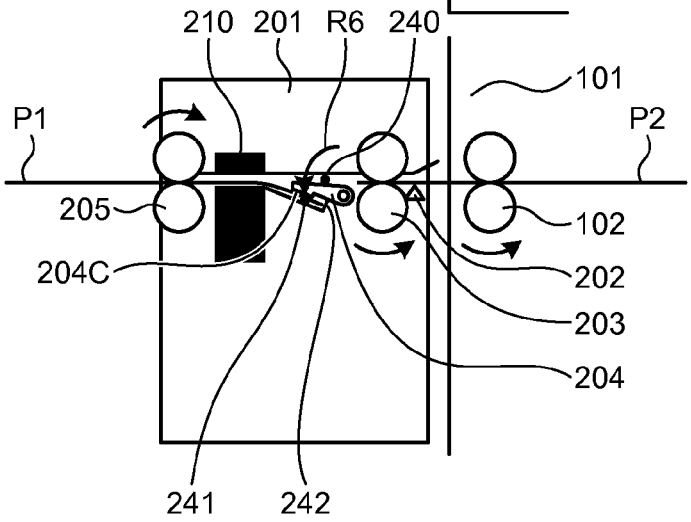

FIGS. 12A and 12B are diagrams illustrating a state where the first sheet P1 is held in the branch path and the second sheet P2 is delivered into the sheet postprocessing apparatus 201. After the preceding first sheet P1 has been aligned with reference to the abutting surface 242, the branching claw 204 is turned in a direction indicated by arrow R6 in FIG. 12B. As a result, a contact surface 204*c*, which is a bottom surface of the branching claw 204, tightly presses down the rear end of the sheet P1, located in the branch path 241, against a surface of the branch path 241 to hold the sheet P1 in an unmovable state. When the following second sheet P2 is delivered from the image forming apparatus 101, the entry roller 203 performs skew correction on the sheet P2 as in the case of the preceding sheet P1. Subsequently, concurrently when the entry roller 203 starts rotating, the discharging roller 205 also starts rotating in the conveying direction.

Figure 13A:
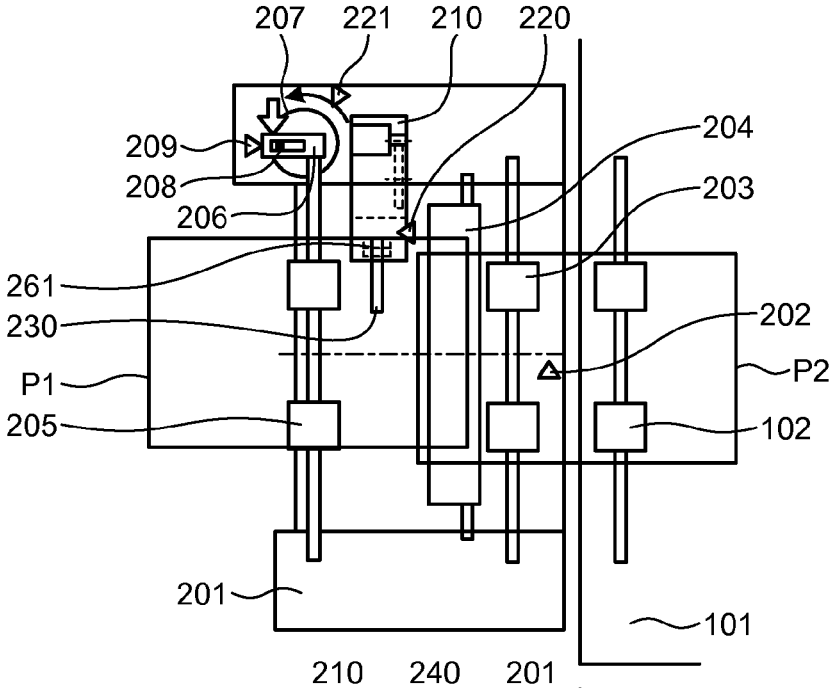
FIGS. 13A and 13B are operation explanatory diagrams illustrating a state, which follows the state illustrated in FIGS. 12A and 12B, where the second sheet has been delivered into the sheet postprocessing apparatus.
Figure 13B:
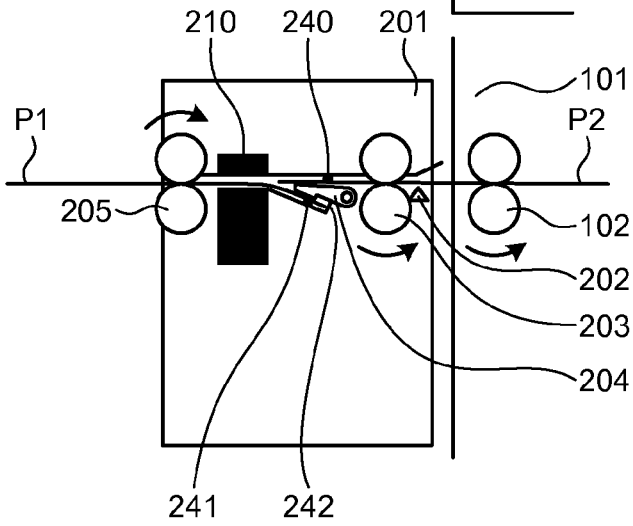

FIGS. 13A and 13B are diagrams illustrating a state where the second sheet P2 has been delivered into the sheet postprocessing apparatus 201. Each time when one of the second sheet P2, and a third and following sheets P3, . . . , and Pn is conveyed from the state illustrated in FIGS. 12A and 12B, the operation illustrated in FIGS. 10A to 11B are performed so that the sheets conveyed from the image forming apparatus 101 are successively moved to the preset position and stacked on one another. As a result, the sheet bundle PB that is aligned is stacked (accumulated) in the conveying path 240.

Figure 14A:
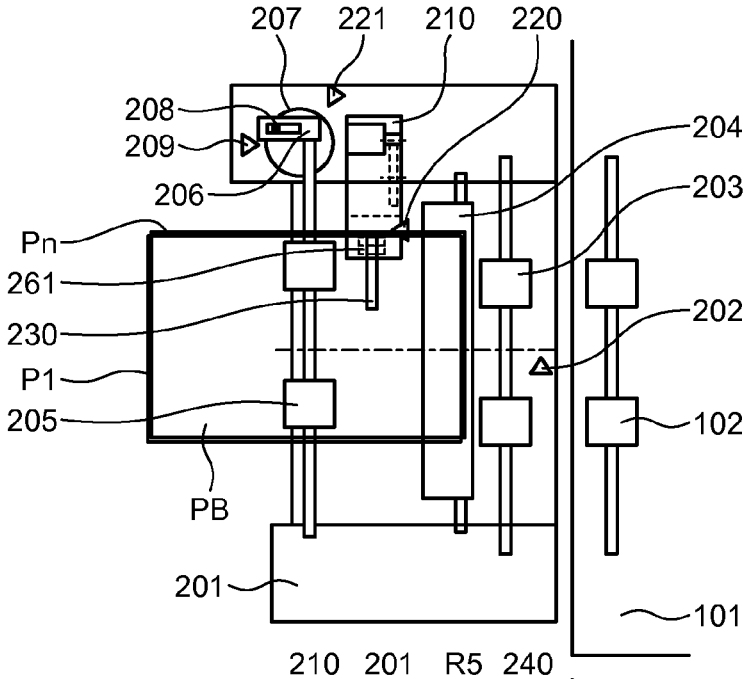
FIGS. 14A and 14B are operation explanatory diagrams illustrating a state, which follows the state illustrated in FIGS. 13A and 13B, where a last sheet is aligned and a sheet bundle is formed.
Figure 14B:
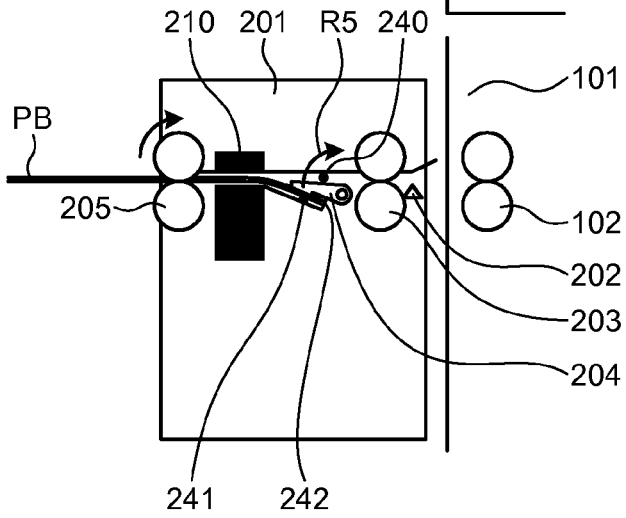

FIGS. 14A and 14B are diagrams illustrating a state where the last sheet Pn is aligned and the sheet bundle PB is formed. When the operation of forming the aligned sheet bundle PB including the last sheet Pn is completed, the discharging roller 205 is rotated by a preset amount in the conveying direction and then stopped. This operation straightens the bend of the sheets that would have been generated when the rear ends of the sheets have abutted on the abutting surface 242. Thereafter, the branching claw 204 is turned in the direction indicated by arrow R5 in FIG. 14B to separate the contact surface 204*c* from the branch path 241, thereby releasing the pressure applied to the sheet bundle PB. As a result, the sheet bundle PB is released from a restraint force applied by the branching claw 204, making it possible to convey the sheet bundle PB using the discharging roller 205.

Figure 15A:
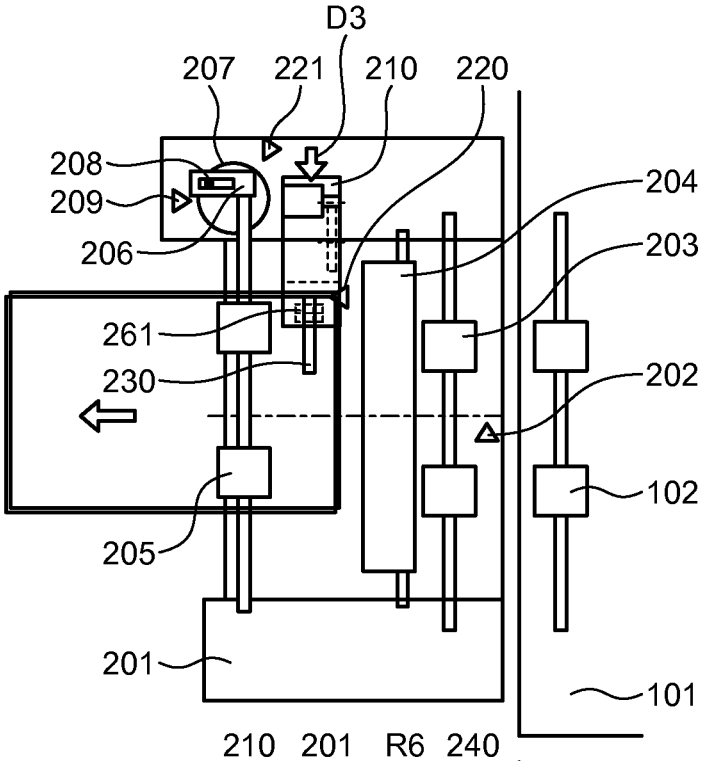
FIGS. 15A and 15B are operation explanatory diagrams illustrating a state, which follows the state illustrated in FIGS. 14A and 14B, where binding is performed.
Figure 15B:
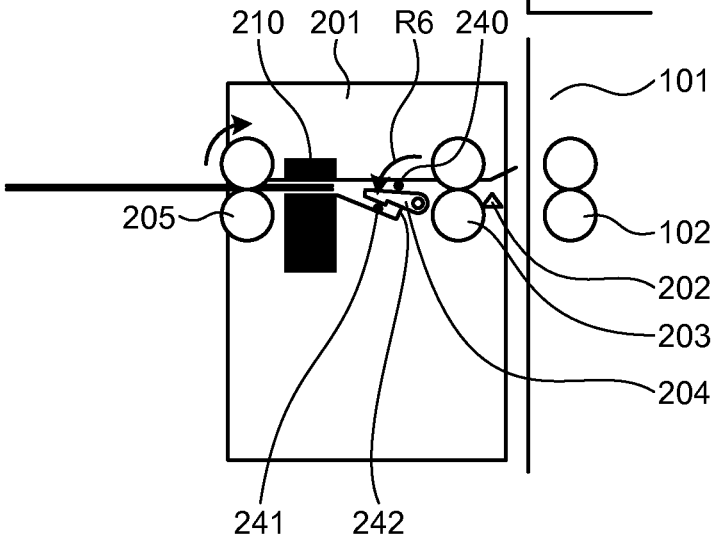

FIGS. 15A and 15B are diagrams illustrating a state when binding is performed. The discharging roller 205 is rotated in the conveying direction from the state illustrated in FIGS. 14A and 14B to convey the sheet bundle PB by a distance that brings the sheet bundle PB to a position where the position of the teeth-like members 261 of the binding device 210 coincides with a binding position of the sheet bundle PB. The discharging roller 205 is stopped when the sheet bundle PB has reached this position. This causes a processing position of the sheet bundle PB in the conveying direction to coincide with the position of the teeth-like members 261 in the conveying direction. The binding device 210 is moved in a direction indicated by an arrow D3 in FIG. 15A by a distance that brings the binding device 210 to a position where the position of the teeth-like members 261 of the binding device 210 coincides with the processing position of the sheets, and stopped. This causes the processing position of the sheet bundle PB in the width direction to coincide with the position of the teeth-like members 261 in the conveying direction and in the width direction. At this time, the branching claw 204 swings in the direction indicated by an arrow R6 in FIG. 15B to return to the sheet-accepting state. Thereafter, compression binding is performed by switching on the binding-device driving motor 265 to cause the teeth-like members 261 to press and squeeze the sheet bundle PB therebetween. In the present embodiment, an example in which the binding device 210 performing the compression binding is used is described. However, as a matter of course, a binding device of another binding method, such as a half-blanking method, a method of cutting and folding sheets, and a method of cutting and folding sheets and further causing a cut portion of the sheets to pass through a cut opening can of the sheets, may be used.

Figure 16A:
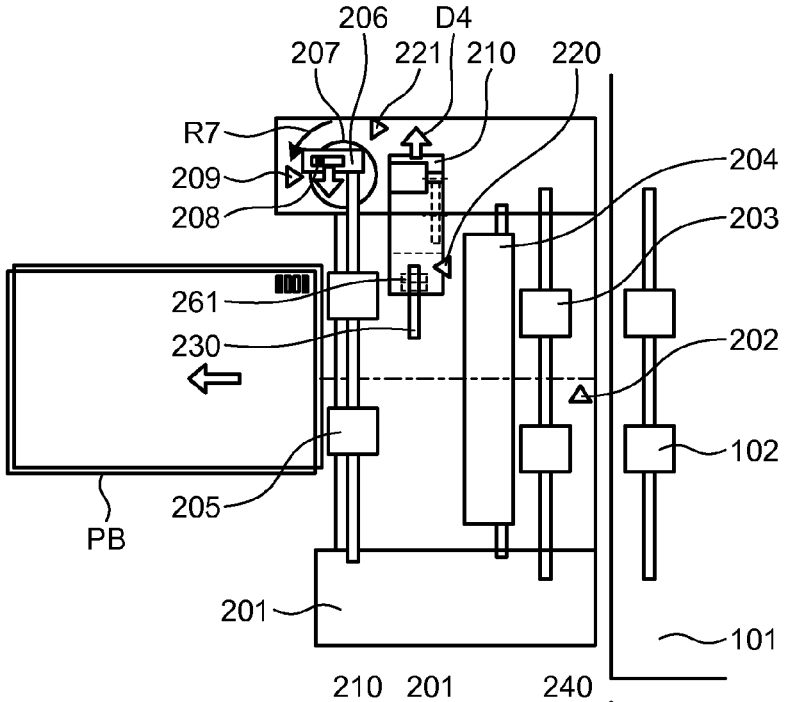
FIGS. 16A and 16B are operation explanatory diagrams illustrating a state, which follows the state illustrated in FIGS. 15A and 15B, where the sheet bundle is discharged.
Figure 16B:
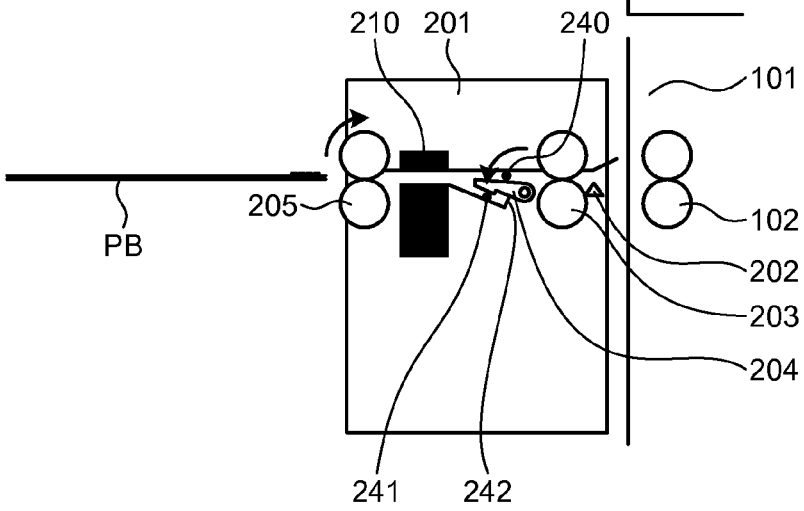

FIGS. 16A and 16B are diagrams illustrating a state when the sheet bundle PB is discharged. The sheet bundle PB bound as illustrated in FIGS. 15A and 15B is discharged by rotation of the discharging roller 205. After the sheet bundle PB has been discharged, the shift cam 207 is rotated in a direction indicated by an arrow R7 to return the shift cam 207 to its home position (the position illustrated in FIGS. 8A and 8B). Simultaneously, the binding device 201 is moved in a direction indicated by an arrow D4 in FIG. 16A to return the binding device 210 to return to its home position (the position illustrated in FIGS. 8A and 8B). Aligning and binding of the sheet bundle PB of one copy (one volume) are thus completed. When there is a next copy, the operations illustrated in FIGS. 8A to 16B are repeated to form another compression-bound sheet bundle PB of the next copy in a similar manner.

Figure 17:
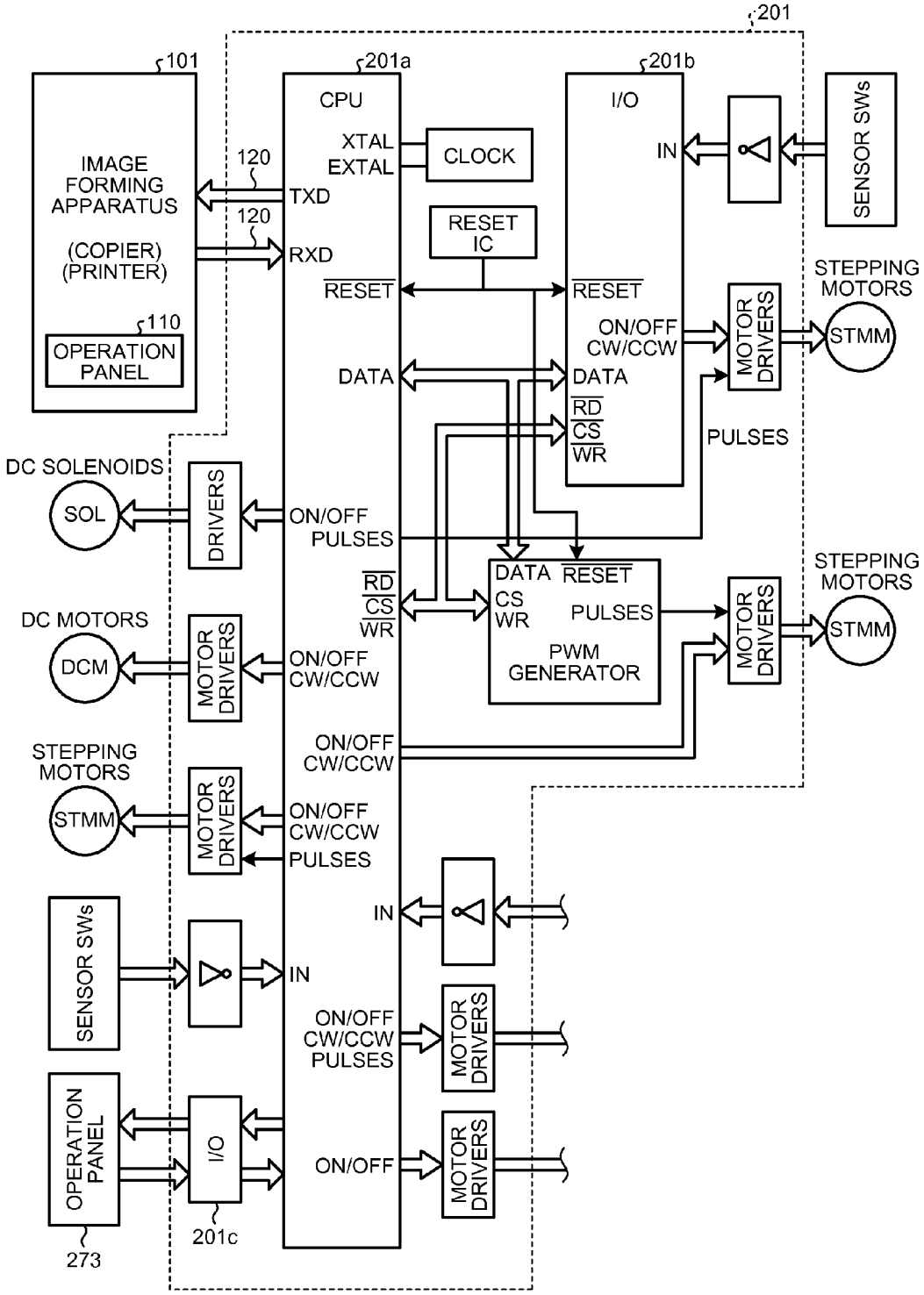
FIG. 17 is a block diagram illustrating a control configuration of the image forming system including the sheet postprocessing apparatus and the image forming apparatus.

FIG. 17 is a block diagram illustrating a control configuration of the image forming system including the sheet postprocessing apparatus 201 and the image forming apparatus 101. A control circuit of the sheet postprocessing apparatus 201 controls the overall sheet postprocessing apparatus 201 and units of the apparatus. The sheet postprocessing apparatus 201 includes the control circuit equipped with a microcomputer that includes the CPU 201*a* and an input/output (I/O) interface 201*b*. Signals are input to the CPU 201*a* from the CPU, switches and the like of an operation panel 110, and sensors (not shown) of the image forming apparatus 101 via a communication interface 120. The CPU 201*a* executes predetermined control according to the input signal. In other words, the sheet postprocessing apparatus 201 is controlled based on an instruction or information fed from the CPU of the image forming apparatus 101. An operating instruction from a user is input using the operation panel 110 of the image forming apparatus 101 or an operation panel 273 provided on the sheet postprocessing apparatus 201. Accordingly, an operation signal input from the operation panel 110 of the image forming apparatus 101 is transmitted to the sheet postprocessing apparatus 201. Notification about a processing status and functions of the sheet postprocessing apparatus 201 is provided to a user via the operation panel 110. The control circuit also includes an I/O interface 201*c* to transmit and receive control signals to and from the operation panel 273 provided on the sheet postprocessing apparatus 201. Control signals from the operation panel 273 of the sheet postprocessing apparatus 201 are input to the CPU 201*a* via the I/O interface 201*c*.

The CPU 201*a* also controls solenoids and motors via drivers and motor drivers and acquires detection data from sensors in the apparatus via an interface. The CPU 201*a* also controls motors using motor drivers and acquires detection data from a sensor via the I/O interface 201*b* depending on a control target and the sensor. The CPU 201*a* performs the control by reading out program codes stored in a read only memory (ROM) (not shown), deploying them into a random access memory (RAM) (not shown), and executing a program defined by the program codes while using the RAM as a working area and a data buffer.

As described above, according to the present embodiment, the following effects can be obtained.

1) The sheet processing apparatus capable of low-volume binding while satisfying demands for cost reduction, space saving, resources saving, and energy saving can be provided.
2) The sheet processing apparatus is configured to be able to perform low-volume binding of approximately five sheets which is the number of sheets office users bind in most cases, on the conveying path. Accordingly, efficiency of the majority of jobs of office users performing sheet binding operation can be increased.
3) Conventionally, there are only two options about introducing a finisher into an office: that is, whether or not to purchase a finisher in consideration of an increase in efficiency and cost. However, according to the present embodiment, the finisher capable of low-volume binding while satisfying demands for cost reduction, space saving, resources saving, and energy saving is added to the options, making it possible to construct a system suitable for office use.
4) Employed is the binding device that does not use a metal staple, such as a binding device that binds a stack of sheets by pressing and squeezing the stack between teeth-like members, a binding device that binds a sheet bundle by half-blanking, a binding device that binds a sheet bundle by cutting and folding the sheet bundle, or a binding device that binds a sheet bundle by cutting and folding a sheets and further causing a cut portion of the sheets to pass through a cut opening of the sheets. Accordingly, reducing electric power for driving a stapler, reducing consumption of consumables, facilitating recycling, and increasing operability in shredding using a shredder can be achieved.
5) The sheet processing apparatus can contribute to resources saving greatly by reducing driving electric power, being configured more compact, reducing consumption of consumables, and facilitating recycling.

A sheet in claims corresponds to P1, P2, . . . , Pn, a sheet bundle corresponds to PB, a sheet processing apparatus corresponds to the sheet postprocessing apparatus 201, a conveying path corresponds to the symbol 240, a conveying unit corresponds to the entry roller 203 and the discharging roller 205, an aligning unit corresponds to the CPU 201*a*, the shift mechanism 205M, the sheet-end detection sensor 220, the discharging roller 205, the abutting surface 242 and the branch path 241, a stacking unit corresponds to the CPU 201*a*, the discharging roller 205, the conveying path 240, the branch path 241 and the branching claw 204, a binding unit corresponds to the binding device 210, a branching claw corresponds to the symbol 240, a shift mechanism corresponds to the symbol 205M, a sheet-end detecting unit corresponds to the sheet-end detection sensor 220, an image forming system corresponds to a system including the image forming apparatus 101 and the sheet postprocessing apparatus 201.

According to an aspect of the present invention, a sheet processing apparatus capable of low-volume binding while satisfying demands for cost reduction, space saving, resources saving, and energy saving can be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus processes a sheet or a sheet bundle, the sheet processing apparatus comprising:

a conveying unit that conveys a sheet along a conveying path;

an aligning unit that, each time a sheet is conveyed by the conveying unit, aligns the sheet;

a stacking unit that reverses a conveying direction of a sheet to convey the sheet backward to a branch path branched from the conveying path, and stacks the sheet in the branch path; and a binding unit that binds a sheet bundle aligned by the aligning unit, in the conveying path, wherein the conveying unit, the aligning unit, the stacking unit, and the binding unit are aligned in a substantially same linear conveyance path direction.

2. The sheet processing apparatus according to claim 1, wherein the aligning unit includes:

a branching claw that guides the sheet conveyed backward to the branch path; and an abutting surface with which a rear end of the sheet is brought into abutment to be aligned with the abutting surface in the conveying direction of the sheet.

3. The sheet processing apparatus according to claim 2, wherein the aligning unit includes:

a shift mechanism that shifts a sheet in a direction perpendicular to the conveying direction of the sheet while conveying the sheet in the conveying direction; and a sheet-end detecting unit that detects a side end of a sheet, and the aligning unit causes the sheet-end detecting unit to detect a side end of a sheet moved by the shift mechanism and causes the shift mechanism to stop moving the sheet so as to align the sheet in the direction perpendicular to the conveying direction of the sheet with reference to a position where the sheet-end detecting unit detects the side end of the sheet.

4. The sheet processing apparatus according to claim 3, wherein the branching claw opens the branch path when a sheet is conveyed backward, and when, after a rear end of a sheet has been aligned with the abutting surface, a next sheet is conveyed, the branching claw closes the branch path and holds the previous sheet on the branch path.

5. The sheet processing apparatus according to claim 4, wherein the aligning unit performs alignment in the direction perpendicular to the sheet conveying direction earlier than alignment in the sheet conveying direction, and each time a sheet is conveyed, the aligning unit performs alignment of the sheet in a state where a sheet having already been conveyed and aligned are held in the branch path.

6. The sheet processing apparatus according to claim 2, wherein the branching claw is arranged downstream of the conveying unit.

7. The sheet processing apparatus according to claim 2, wherein the branching claw is configured to swing within a preset range of an angle about a fulcrum shaft to switch a sheet conveying pathway between the conveying path and the branch path.

8. The sheet processing apparatus according to claim 7, wherein the branching claw is constantly resiliently biased by a spring.

9. The sheet processing apparatus according to claim 8, wherein the spring is hooked onto a branching claw movable lever section, and a plunger of a branching solenoid is linked to the branching claw movable lever section.

10. The sheet processing apparatus according to claim 9, wherein when the branching solenoid is switched on, the branching claw swings in a direction to close the conveying path and open the branch path, thereby being able to guide the sheet to the branch path.

11. The sheet processing apparatus according to claim 3, further comprising a discharging unit that conveys, shifts, and discharges the sheet.

12. The sheet processing apparatus according to claim 11, wherein the discharging unit is arranged a most downstream exit of the conveying path.

13. The sheet processing apparatus according to claim 11, wherein the shift mechanism includes a shift link, a shift cam, a shift cam stud, and a shift-home position detector.

14. The sheet processing apparatus according to claim 13, wherein the shift link is arranged on a shaft end of the discharging unit and receives a moving force for the shifting.

15. The sheet processing apparatus according to claim 13, wherein the shift cam stud converts a rotational movement of the shift cam into a linear movement of the discharging unit in an axial direction thereof by being interlocked with a shift-link elongated hole.

16. The sheet processing apparatus according to claim 13, wherein a position of the shift link where the shift link is detected by the shift-home-position detector is determined as a home position.

17. The sheet processing apparatus according to claim 1, wherein the binding unit binds a sheet bundle by pressing the sheet bundle to utilize inter-sheet adhesion provided by compression binding or deformation of sheets.

18. The sheet processing apparatus according to claim 1, wherein the binding unit includes a sheet-end detection detector, a binding-device-home-position detector, and a guide rail to move the binding unit.

19. An image forming system including a sheet processing apparatus that processes a sheet or a sheet bundle, the sheet processing apparatus comprising:

a conveying unit that conveys a sheet along a conveying path;

an aligning unit that, each time a sheet is conveyed by the conveying unit, aligns the sheet;

a stacking unit that reverses a conveying direction of a sheet to convey the sheet backward to a branch path branched from the conveying path, and stacks the sheet in the branch path; and a binding unit that binds a sheet bundle aligned by the aligning unit, in the conveying path, wherein the conveying unit, the aligning unit, the stacking unit, and the binding unit are aligned in a substantially same linear conveyance path direction.

20. A method of processing a sheet or a sheet bundle, the method comprising:

conveying, by a conveying unit, a sheet along a conveying path;

aligning, each time a sheet is conveyed by the conveying unit, the sheet;

stacking, during the aligning, a sheet in a branch path branched from the conveying path by reversing a conveying direction of the sheet to convey the sheet backward to the branch path; and binding an aligned sheet bundle stacked at the stacking, in the conveying path, wherein the conveying unit, the aligning unit, the stacking unit, and the binding unit are aligned in a substantially same linear conveyance path direction.

* * * * *